US011885348B2

(12) United States Patent
Mosiewicz

(10) Patent No.: US 11,885,348 B2
(45) Date of Patent: Jan. 30, 2024

(54) AXIAL FAN WITH TRAILING EDGE FLAP

(71) Applicant: R.E.M. HOLDING S.R.L., Milan (IT)

(72) Inventor: Roberto Eduardo Mosiewicz, Arona (IT)

(73) Assignee: R.E.M. HOLDING S.R.L., Milan (IT)

( * ) Notice: Subject to any disclaimer, the term of this patent is extended or adjusted under 35 U.S.C. 154(b) by 225 days.

(21) Appl. No.: 17/438,075

(22) PCT Filed: Mar. 16, 2020

(86) PCT No.: PCT/IB2020/052379
§ 371 (c)(1),
(2) Date: Sep. 10, 2021

(87) PCT Pub. No.: WO2020/188463
PCT Pub. Date: Sep. 24, 2020

(65) Prior Publication Data

US 2022/0186741 A1 Jun. 16, 2022

(30) Foreign Application Priority Data

Mar. 20, 2019 (IT) ..... 102019000004059

(51) Int. Cl.
*F04D 29/34* (2006.01)
*F01D 5/14* (2006.01)
*F04D 19/00* (2006.01)

(52) U.S. Cl.
CPC ..... *F04D 29/34* (2013.01); *F01D 5/146* (2013.01); *F04D 19/002* (2013.01)

(58) Field of Classification Search
CPC ..... F04D 29/324; F04D 29/325; F04D 29/36; F04D 29/384; F04D 19/002; F01D 5/146
See application file for complete search history.

(56) References Cited

U.S. PATENT DOCUMENTS 2,132,133 A 10/1938 Smith
4,599,041 A 7/1986 Stricker
(Continued)

FOREIGN PATENT DOCUMENTS

FR 951186 10/1949
GB 1085390 A 9/1967

OTHER PUBLICATIONS

International Search Report issues for International Application No. PCT/IB2020/052379 dated Jun. 19, 2020, 3 pages.

*Primary Examiner* — David E Sosnowski
*Assistant Examiner* — Jackson N Gillenwaters
(74) *Attorney, Agent, or Firm* — Maier & Maier, PLLC

(57) ABSTRACT

The invention relates to a blade assembly 30 for a large dimension axial fan 32 having a rotation axis X. The blade assembly of the invention comprises: a root structure 34 intended to mechanically connect the blade assembly to a hub 36; a blade, wherein at least one portion of the blade has a composite airfoil 46 comprising a fore semi-airfoil 48 and an aft flap 50, wherein: the semi-airfoil is intended to be assembled at a predefined pitch angle $\alpha_c$ with respect to the hub 36 by means of the root structure; the flap 50 is mounted on the blade such that it can be fixed in a position comprised between a maximum deflection position and a minimum deflection position with respect to the pitch angle $\alpha_c$; and between the fore semi-airfoil and the aft flap a channel 54 is defined suitable for allowing a fluid flow from the face v to the back d of the composite airfoil. The invention further relates to a fan comprising a plurality of blades.

14 Claims, 16 Drawing Sheets

(56) References Cited

U.S. PATENT DOCUMENTS

| | | | | |
|---|---|---|---|---|
| 9,945,357 | B2 * | 4/2018 | Enevoldsen | F03D 7/0204 |
| 10,036,392 | B2 * | 7/2018 | Gallina | F04D 19/002 |
| 10,259,565 | B2 * | 4/2019 | Ramakrishnan | B64D 33/04 |
| 2011/0081246 | A1 * | 4/2011 | Aynsley | F04D 29/388 416/204 R |
| 2016/0138601 | A1 | 5/2016 | Gallina | |
| 2020/0191004 | A1 * | 6/2020 | Prasad | F01D 17/16 |

* cited by examiner

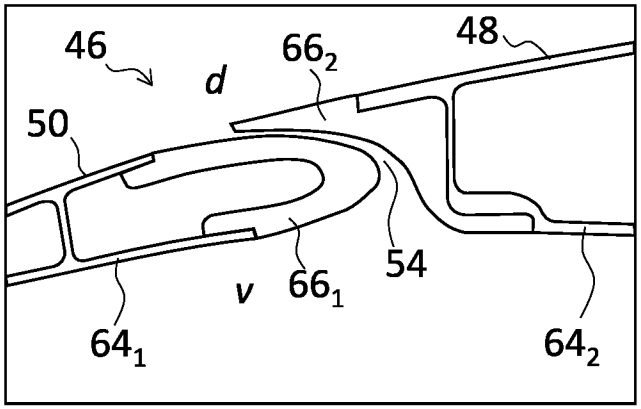
Fig. 18.b
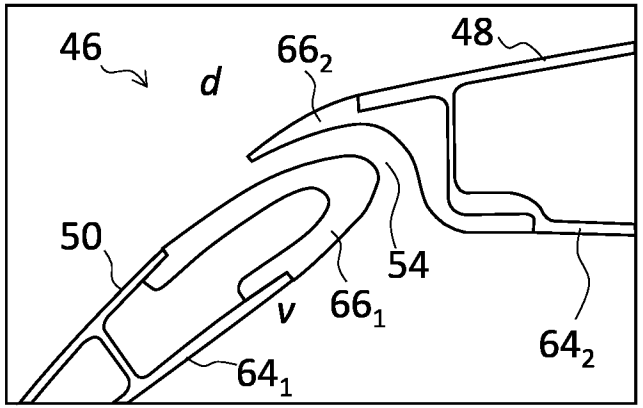
Fig. 20
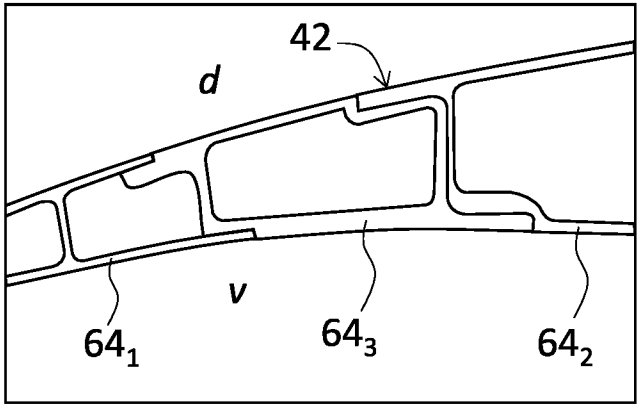
Fig. 18.a
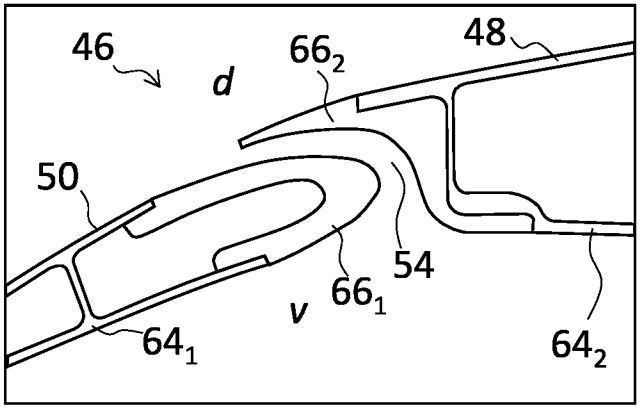
Fig. 19

AXIAL FAN WITH TRAILING EDGE FLAP

The present invention relates to a blade for an axial fan, in particular for a large dimension ducted axial fan for industrial use. By large diameter axial fan is meant herein and hereinafter an axial fan having a diameter D greater than 1 metre.

In the industrial field, the use of large diameter axial fans is known, typically in order to ensure an adequate flow of air around special radiant surfaces, in systems that require the dissipation of significant amounts of heat.

Axial fans for industrial use typically comprise a central hub defining a rotation axis and on which is mounted a plurality of blades. The hub rotation rotates the blades and, as the skilled person can understand, imposes different tangential speeds for the different sections of each blade. In fact, the tangential speed of each blade section is the product of the angular speed (which is equal for all sections) and the radial distance with respect to the rotation axis (which increases while moving away from the rotation axis).

Knowingly, the operating characteristics of a fan are defined by a set of construction parameters such as overall rotor diameter, blade foil, blade pitch angle on hub, blade number, rotor rotation speed, motor power, etc. For each fan configuration defined during the project by fixing the construction parameters, a characteristic curve is obtained on the Flow-Pressure plane. An example of such a characteristic curve is qualitatively shown in the diagram of FIG. 5, where the dashed lines indicate the different characteristic curves obtained for pitch angles $\alpha_c$ increasing from $\alpha_{c1}$ to $\alpha_{c8}$. The characteristic curves are bounded above by a line marking the stalling condition, while below they are bounded by the curve indicating the dynamic pressure. The thin stroke continuous curves provide indications of the efficiency $\varepsilon$ of the fan. More in particular, each of the efficiency curves $\varepsilon_n$ indicates different working conditions in flow and pressure but having equal efficiency. In addition, as a whole, efficiency curves $\varepsilon_n$ have the same role as isoipses (or level curves) in a topographic map, indicating the overall efficiency trend as a function of flow and pressure. In the specific diagram of FIG. 5, the efficiency increases from $\varepsilon_1$ to $\varepsilon_7$.

Each specific industrial application in which the use of a fan is required defines a predetermined flow rate value under steady-state conditions at full speed. Therefore, the operating point $P_f$ at steady speed is defined for the fan by the point of the characteristic curve that guarantees the required flow rate.

Axial fans of a known type are widely used due to their ease of construction and operation, their relatively low cost and the wide range of operating speeds they can guarantee.

However, these solutions, although widely appreciated, are not without drawbacks.

In fact, as is known to the skilled person, the blades of the axial fans are not able to operate effectively along their entire radial opening. The tangential speed of the innermost sections of the blade is often too low to achieve an effective relative motion with respect to the air flow. It follows that the actual operation of the fan is entrusted only to the external sections that guarantee almost all of the total air flow generated by the axial fan. Often, in order to simplify the construction of the blades, the inner sections do not even have an airfoil and are simply intended to perform a mechanical function of supporting the outer sections.

The graph of FIG. 7 qualitatively shows the distribution of the air flow generated by the fan as a function of the radial distance from the rotation axis X. As observable, most of the flow is generated by sections which are close to the radially outer end of each blade.

As the skilled person can understand, such flow distribution makes the axial fan inefficient as a whole.

Furthermore, as observable in FIG. 5, the operating point at full speed $P_f$ of the specific fan in the specific application does not always coincide with the maximum efficiency point $P\varepsilon_{max}$ of the fan itself. In other words, in almost the entire operating life of the fan, the potential of the fan is not fully exploited. This results in a waste of a significant share of the energy used to operate the fan.

Of course, by changing the design parameters of the fan, it is possible to modify the characteristic curve so as to bring the operating point $P_f$ closer to the maximum efficiency point $P\varepsilon_{max}$. However, each of the parameters is subject to external constraints that severely limit the actual possibility of variation. Specifically in FIG. 5, for example, efficiency $\varepsilon$ could be slightly improved at the same flow rate by changing the pitch angle $\alpha_c$ to an intermediate value between $\alpha_{c4}$ and $\alpha_{c3}$. In this way, at the same flow rate, a slightly lower pressure and a slightly higher efficiency would be obtained. However, it is not at all certain that in reality the pitch angle $\alpha_{c4}$ can be in fact varied at will. Furthermore, as the skilled person can well detect from the graph of FIG. 5, even by varying the pitch angle $\alpha_c$, the efficiency that can be obtained remains anyway far from the maximum efficiency of the point $P\varepsilon_{max}$.

For how large diameter fans are made, one of the most difficult parameters to vary during the project is the blade foil. In fact, due to the low overall cost that the fan must have for the end user, the blades must be obtained by extrusion or by pultrusion, starting from a very limited number of dies. Therefore, the aerodynamic sections of the blades, made of aluminium alloy or fibre-reinforced composite material, usually have a constant section. Subsequently, the blades that have been made separately are assembled on the hub in the number and with the pitch angle defined during the project.

This method of construction clearly differentiates large fans from medium-small fans, for example those used for cooling electronic devices, for automotive applications or for domestic ventilation. For the purpose of this discussion, a fan is considered large when it has a rotor with a diameter D greater than 1 metre.

Medium-small fans, precisely because of their small size and the large number of units in which they are produced, can be made economically via technologies such as injection moulding. Such production technology allows the rather economical construction of monolithic rotors with blades shaped according to even very complex shapes. In the case of the large axial fans considered herein, these construction technologies cannot be employed for various reasons. Firstly, the large dimension of the fans does not allow the moulding of a one-piece rotor. In addition, the relatively low number of specimens to be produced also discourages the injection moulding technique for the construction of the single blade. Even if these technological and economic problems were overcome, in any case the relationships between aerodynamic forces, mass forces and the mechanical characteristics of large dimension blades prevent the use of moulded plastics to make parts for structural purposes.

Therefore, the object of the present invention is to overcome the drawbacks underlined before with respect to the prior art.

In particular, a task of the present invention is to provide a blade for an axial fan that allows to improve the overall efficiency of the fan.

Furthermore, a task of the present invention is to provide a blade for an axial fan that allows to vary the configuration in order to vary the characteristic curve of the fan.

Such object and such tasks are achieved by means of a blade assembly for fan according to claim 1.

To better understand the invention and appreciate its advantages, some of its exemplifying and non-limiting embodiments are described below with reference to the accompanying drawings, wherein.

Figure 17:
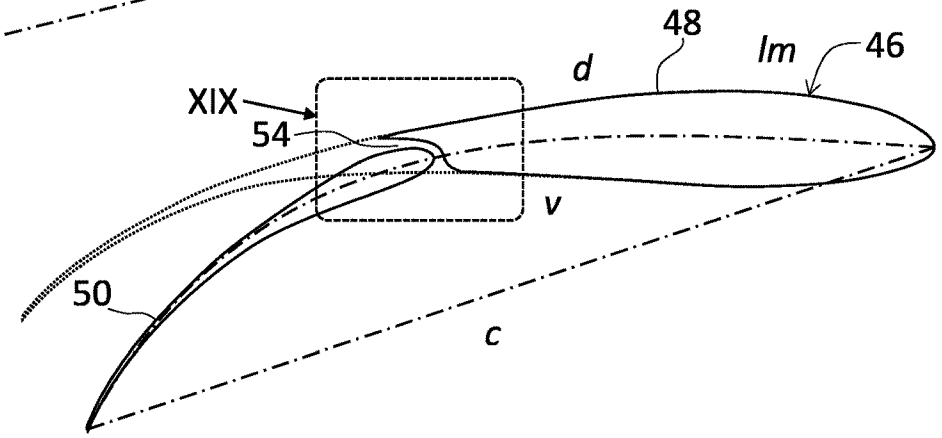
FIG. 17 is a schematic view of the section operated along the line XVII-XVII of FIG. 14.
Figure 22:
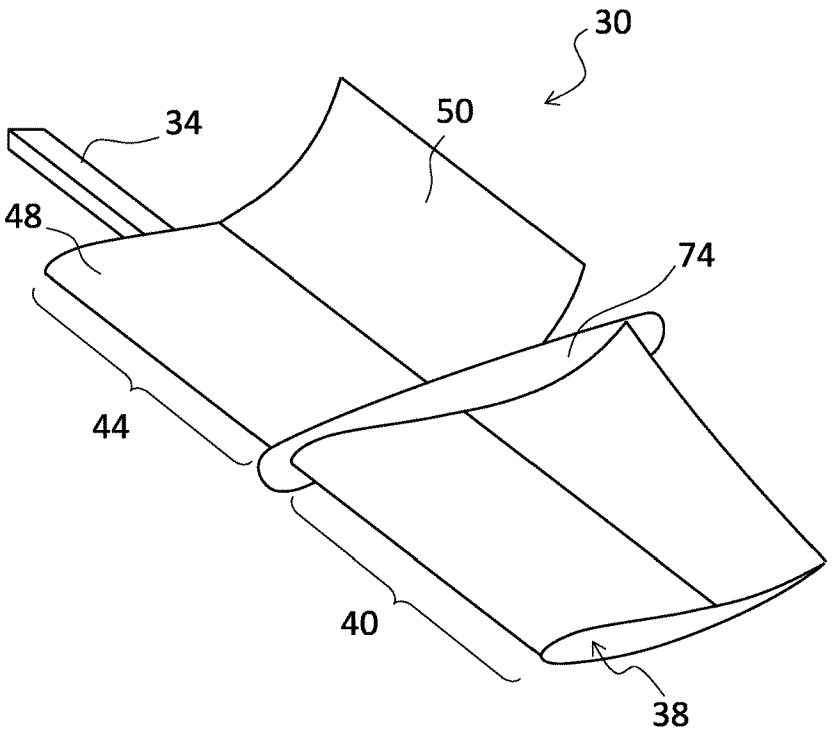
Figure 21:
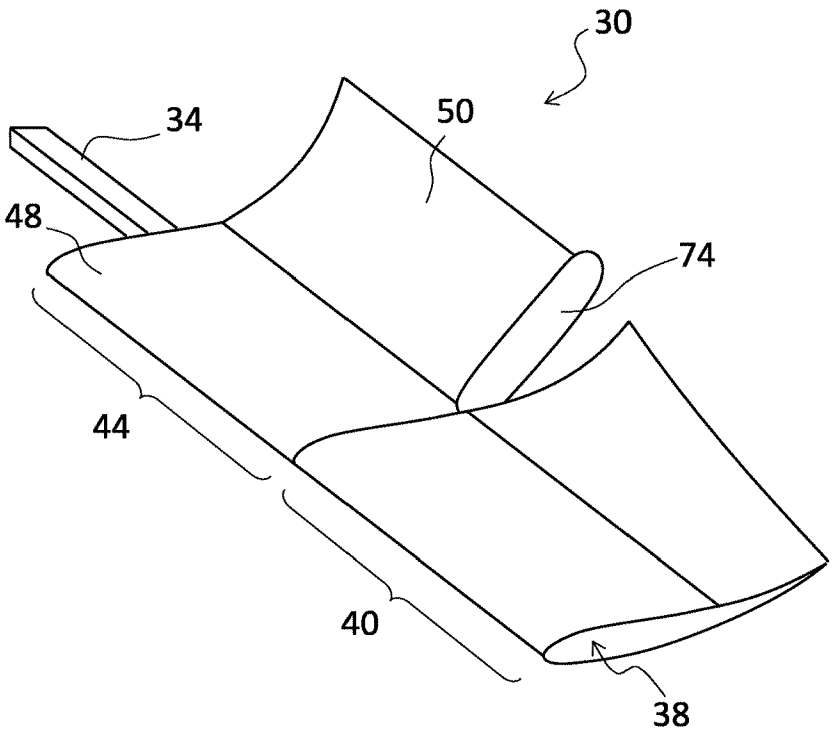
Figure 24:
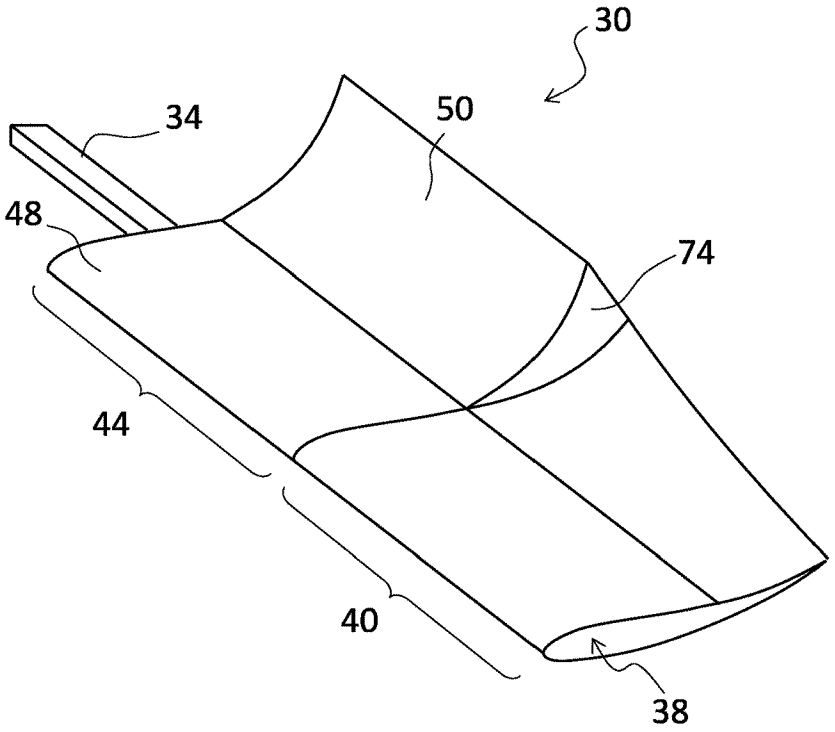
Figure 23:
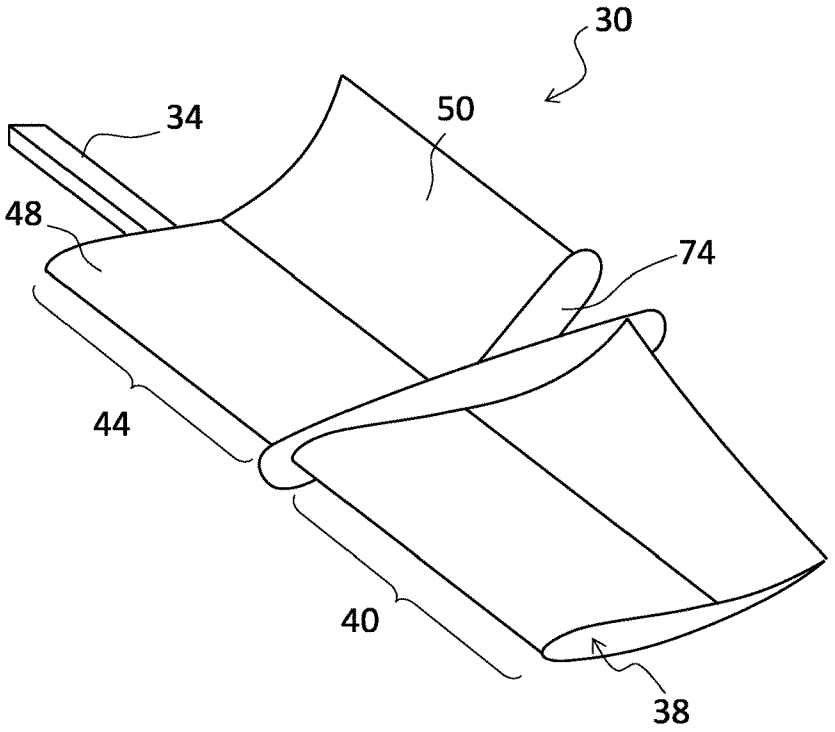

FIG. 18.*a* is an enlarged schematic view of the detail referred to as XVIII in FIG. 17;

FIG. 18.*b* is an alternative schematic view of the detail referred to as XVIII in FIG. 17;

FIG. 19 is an enlarged schematic view of the detail referred to as XIX in FIG. 17;

FIG. 20 is a schematic view of a detail similar to that of FIGS. 18.*b* and 19; and FIGS. 21 to 24 are various axonometric views of blade assemblies according to the invention.

In according to a first aspect, the present invention relates to a blade assembly 30 for a large dimension axial fan 32 having a rotation axis X.

The blade assembly 30 of the invention comprises:

- a root structure 34 intended to mechanically connect the blade assembly 30 to a hub 36 of the axial fan 32;
- a blade 38, wherein at least one portion of the blade 38 has a composite airfoil 46 comprising a fore semi-airfoil 48 and an aft flap 50, wherein:
  - the semi-airfoil 48 of the blade 38 is intended to be assembled with a predefined pitch angle $\alpha_c$ with respect to the hub 36 of the axial fan 32 by means of the root structure 34;
  - the flap 50 is mounted on the blade 38 such that it can be fixed in a position comprised between a maximum deflection position and a minimum deflection position with respect to the pitch angle $\alpha_c$; and
  - between the fore semi-airfoil 48 and the aft flap 50 a channel 54 suitable for allowing a fluid flow from the face v to the back d of the composite airfoil 46.

Figure 4:
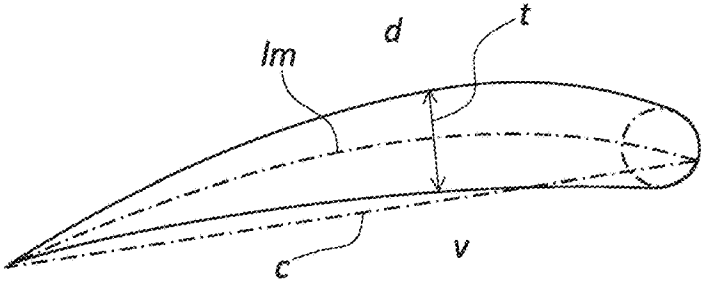
Fig. 4 (prior art)
FIG. 4 is a schematic view of an airfoil according to the prior art.

In the context of the present discussion, some terminological conventions have been adopted in order to make reading easier and smoother. These terminological conventions refer to concepts commonly known in aerodynamics. The use thereof in the present discussion is maintained at an intuitive level since the strict definitions from the geometric point of view may differ between the different authors. Some terminological conventions are explained in the following, with particular reference to the appended FIG. 4.

With the term airfoil or aerodynamic foil is meant a foil specially designed to ensure high efficiency in the production of aerodynamic forces, i.e. from the interaction with a fluid flow. In a known manner, an airfoil, for example that of FIG. 4, has a rounded leading edge which is invested by the fluid flow; in FIG. 4 the osculating circle that approximates the airfoil in the leading edge is highlighted. In an equally well-known manner, the airfoil has also a sharp trailing edge from which the fluid flow moves away. The leading edge also identifies the "fore" area of the foil while the trailing edge identifies the "aft" area. The distance between the leading edge and the trailing edge is called foil chord c. Each individual foil can then be characterized by a curvature, intuitively indicated with the centreline Im of the foil.

Figure 1:
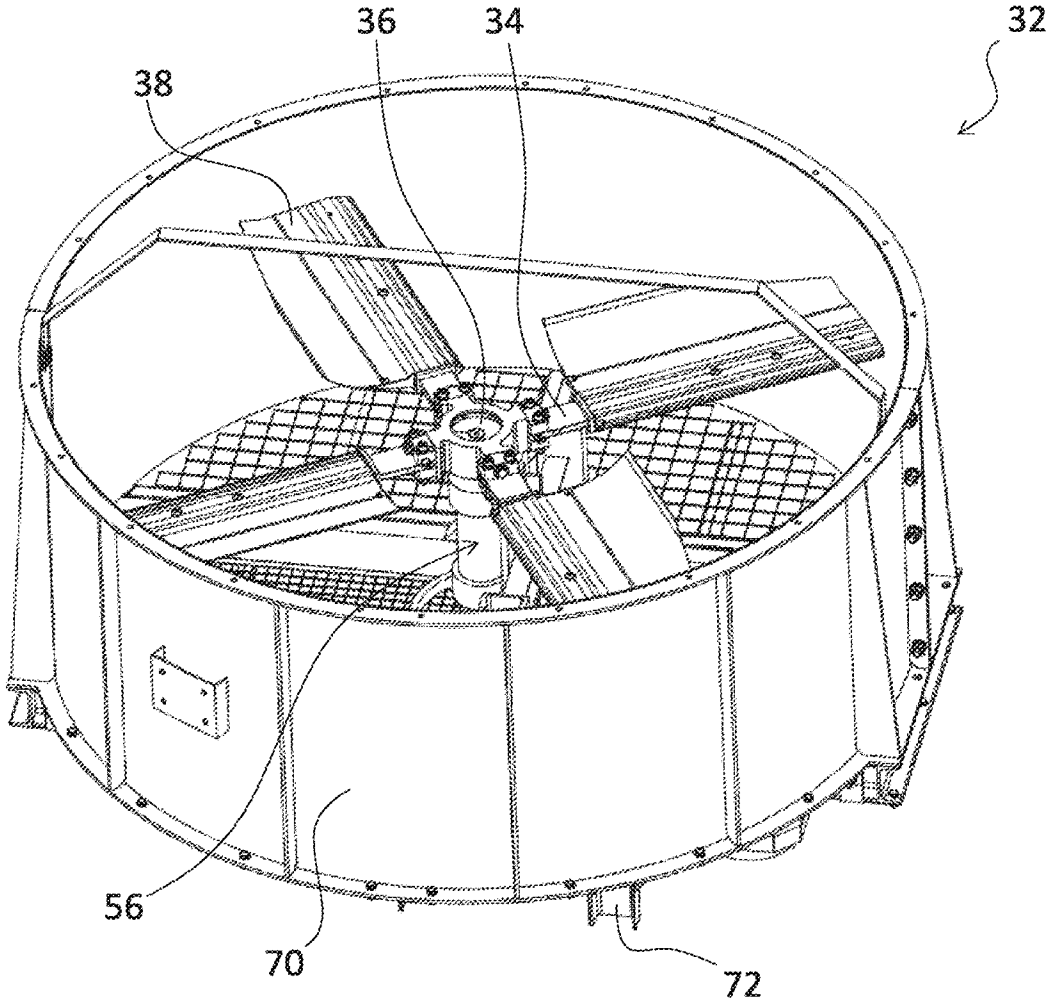
Fig. 1 (prior art)
FIG. 1 is an axonometric view of a large diameter axial fan according to the prior art.
Figure 3:
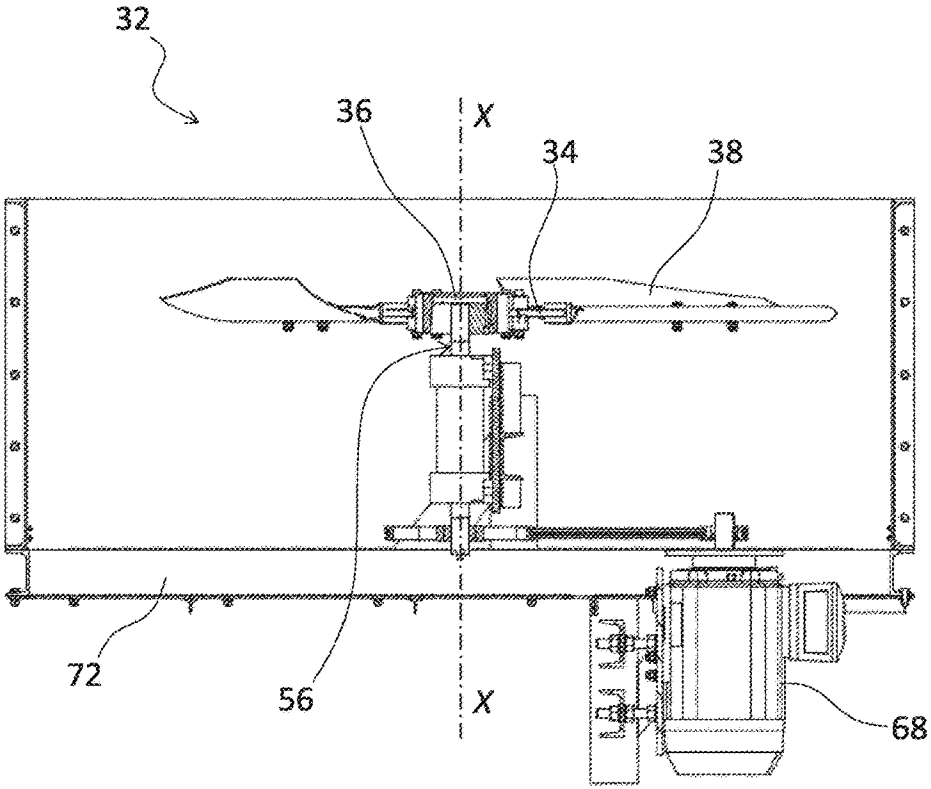
Fig. 3 (prior art)
FIG. 3 is a view of the section operated along the line III-III of FIG. 2.

The airfoils have been studied mainly for their use in aircraft wings, use in which the foils are intended to generate a lift (i.e. an aerodynamic force directed upwards). For this reason, the most common representation of the foil is that of FIG. 4, wherein the curvature of the foil has a downward-facing concavity. With reference to this representation, the convex part of the foil is said back d and the concave part is said face v. It should be noted, however, that in other applications the airfoils may be employed to generate forces oriented in different directions, e.g., a downforce (i.e., an aerodynamic force directed downwards). For example, in the application of FIGS. 1 and 3, the blades 38 of the axial fan 32 are assembled on the hub 36 such that the foils are inverted with respect to that of FIG. 4. Notwithstanding this, the following discussion maintains the most common terminology indicated above, wherein back d indicates the convex part of the foil and face v indicates the concave or flat part.

The distance between the back d and the face v defines the thickness t of the foil. Usually in the airfoils, as in the example of FIG. 4, running along the midline Im from the leading edge to the trailing edge, the thickness t of the foil rapidly increases, reaches a maximum within the first half of the chord (usually between ¼ and ⅓) and then gradually decreases, proceeding towards the trailing edge, until it becomes null without abrupt variations.

The axial fan 32 of the invention univocally defines a rotation axis X. With respect to this rotation axis X, the geometric concepts of "axial", "radial", and "tangential" are defined.

As already mentioned above, a large diameter axial fan 32 is defined herein and hereinafter an axial fan 32 having a diameter greater than 1 metre.

Figure 2:
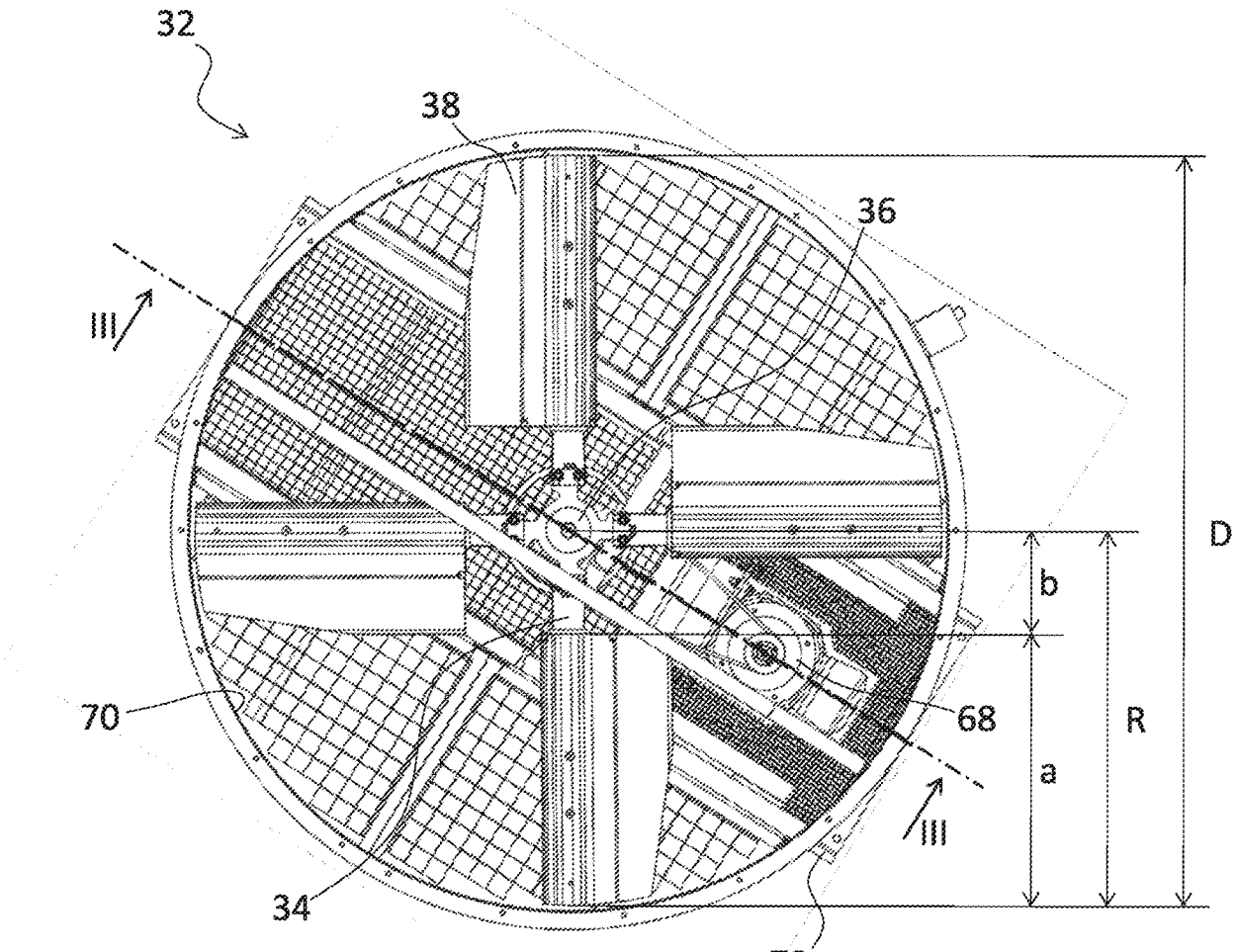
Fig. 2 (prior art)
FIG. 2 is a plan view of the fan of FIG. 1.

As mentioned above, the blade 38 itself (which is designed to perform aerodynamic functions) is intended to be connected to the hub 36 of the axial fan 32 by means of a root structure 34 (which is designed to perform only mechanical functions). The blade 38 has radial extension a, while the root structure 34 together with the radius of the hub 36 of the axial fan 32 have overall radial extension b. For the purposes of this discussion, the distinction between the radial extension of the root structure 34 and the radial extension of the hub 36 is of no importance, since both of these elements merely perform mechanical functions. The sum of a and b determines the radius R of the rotor 56, equal to half the diameter D of the rotor 56 of the axial fan 32. To this purpose, see in particular FIGS. 2 and 9.

According to some embodiments, the blade portion 38 having the composite airfoil 46 is at least a radially inner portion 44, while a radially outer portion 40 has a simple airfoil 42. If present, the single airfoil 42 is intended to be assembled at a predefined pitch angle $\alpha_c$ with respect to the hub 36, preferably in a continuity with the pitch angle $\alpha_c$ of the semi-airfoil 48. As the skilled person can understand, it is not easy to provide a single definition of the pitch angle $\alpha_c$ that applies simultaneously to a simple airfoil 42 and a semi-airfoil 48. However, it is easy to understand, while remaining at an intuitive level, what the respective pitch angles may be in order to obtain continuity between the semi-airfoil 48 and for the possible simple airfoil 42. Attached FIGS. 11 and 15-17 unequivocally clarify this concept.

Preferably the simple airfoil 42 and the composite airfoil 46 have chord c and thickness distribution t substantially equal to each other. One possible embodiment of such foils is described below.

According to certain embodiments, the radially outer portion 40 of the blade 38, having the simple airfoil 42, has radial extension e while the radially inner portion 44 of the blade 38, having the composite airfoil 46, has radial extension f.

According to certain embodiments, f is comprised between 20% and 70% of a, even more preferably f is comprised between 40% and 60% of a.

In other embodiments of the invention, the various portions of the blade have a radial extension substantially equal the one to the other. In particular, the radial extension e of the radially outer portion 40 is substantially equal to the radial extension f of the radially inner portion 44. Furthermore, the airfoils (being single 42 or composite 46) of the various portions 40 and 44 of the blade 38 have chords c substantially equal to each other, at least in one respective section. In particular, the chord of the composite airfoil 46 is substantially equal to the chord of the simple airfoil 42 when this is considered in the radially innermost section of the radially outer portion 40 of the blade 38. For radially outermost sections, the tapering of the blade 38 of FIG. 9 introduces a difference between the chords c.

For the purposes of this discussion, "substantially equal" means that the difference between the two measures is less than 10% of the larger measure between the two.

Figure 11:
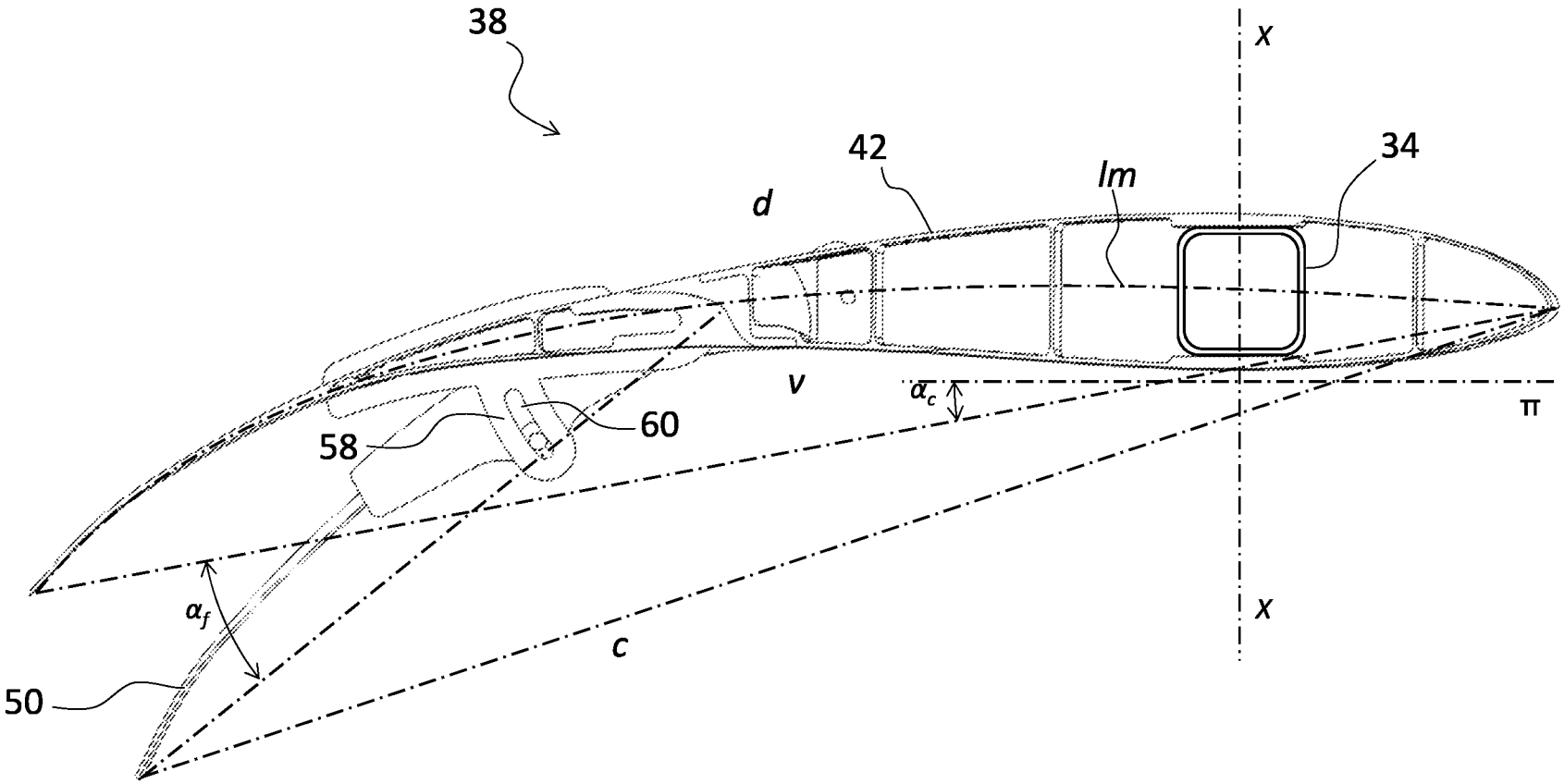
FIG. 11 is a view of the blade taken along the direction XI-XI of FIG. 9.
Figure 12:
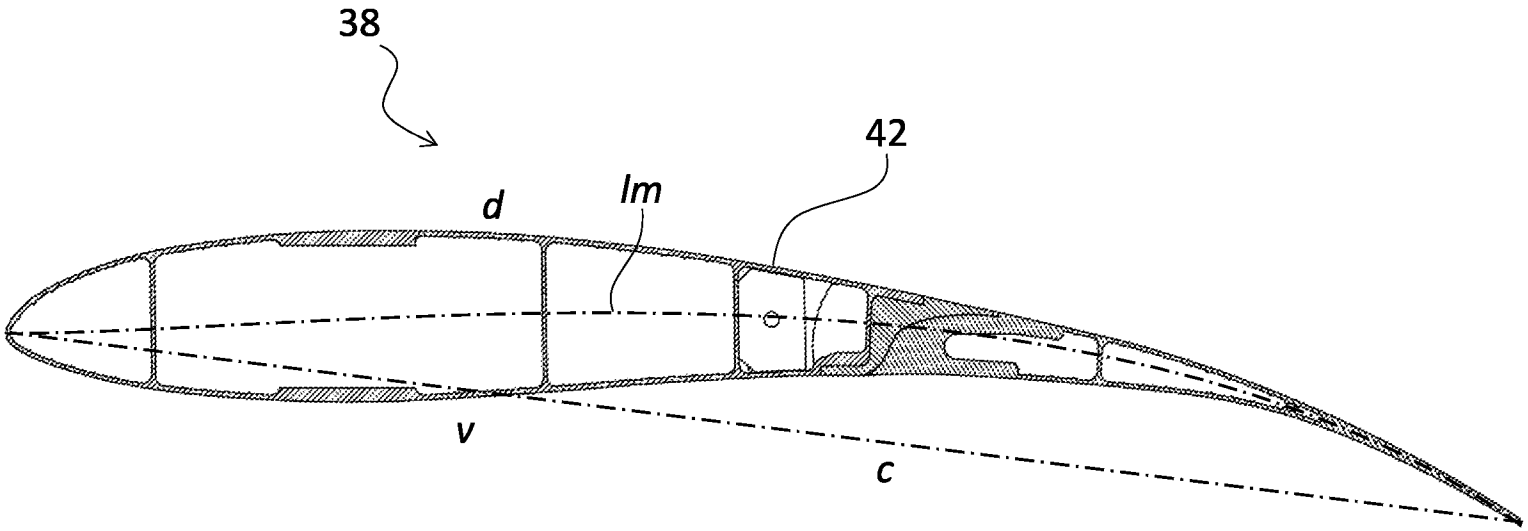
FIG. 12 is a sectional view taken along the line XII-XII of FIG. 9.

As it can be seen in the accompanying FIGS. 11 and 12, the simple airfoil 42 of the radially outer portion 40 of the blade 38 has all the typical characteristics of a common airfoil: it has a rounded leading edge, a pointed trailing edge and a customarily distributed thickness. In particular, traveling along the midline Im of the simple airfoil 42 from the leading edge to the trailing edge, the thickness t of the foil increases rapidly, reaches a maximum within the first half of the chord and then gradually decreases, proceeding towards the trailing edge, until it becomes null without abrupt variations.

As can be seen in the attached FIGS. 10, and 15-17, similar characteristics can be identified in the foil of the flap 50. The flap 50 is therefore shaped as a customary airfoil.

On the contrary, the fore semi-airfoil 48 is preferable to have different geometric characteristics. In particular, as can be seen in FIGS. 10, and 15-17, the semi-airfoil 48 has a rounded leading edge, but has a different thickness distribution along its midline and a bulky trailing edge. In the semi-airfoil 48, traveling along the midline from the leading edge to the trailing edge, the thickness t of the foil rapidly increases, reaches a maximum within the first half of the chord and then is gradually reduced by proceeding towards the trailing edge, and then undergoes a sharp decrease near the latter. With reference to the sharp decrease in thickness t near the trailing edge, it should be noted that in the embodiment of FIG. 10 the semi-airfoil maintains 50% of its maximum thickness up to more than 80%, preferably more than 85% of its chord, considering 0% the leading edge and 100% the trailing edge. In addition, the pointed part of the trailing edge is moved near the back d of the semi-airfoil 48. In other words, the semi-airfoil 48 of the radially inner portion 44 of the blade 38, when employed alone, is not particularly efficient for generating aerodynamic forces, since the abrupt decrease in thickness t near the trailing edge involves a remarkable fluid flow disturbance moving away from the semi-airfoil 48. The flow disturbance easily generates turbulence that limits the foil efficiency.

However, in the use of the invention the semi-airfoil 48 is not isolated but is followed at a short distance by the flap 50. In other words, the semi-airfoil 48 and the flap 50 together constitute the composite airfoil 46 of the blade 38. From an aerodynamic point of view, the composite airfoil 46 is an organic unit that exploits the synergy between the semi-airfoil 48 and the flap 50.

In particular, the flap 50 is mounted on the blade 38 such that it can be oriented as desired and fixed in a predetermined position. In other words, during the assembly of the axial fan 32, the flap 50 can be oriented according to a deflection angle $\alpha_f$ of predefined during the design step. By way of example, the deflection angle $\alpha_f$ of the flap 50 may be defined as the angle comprised between the flap chord 50 and the chord of a simple airfoil 42 having chord c and thickness distribution t substantially equal to those of the composite foil 46 (see FIG. 10). The possibility of orienting the flap 50 allows to increase the overall curvature of the composite airfoil 46. As is known to the skilled person, within certain limits, the increase in curvature increases the lift coefficient of a given airfoil.

Figure 10:
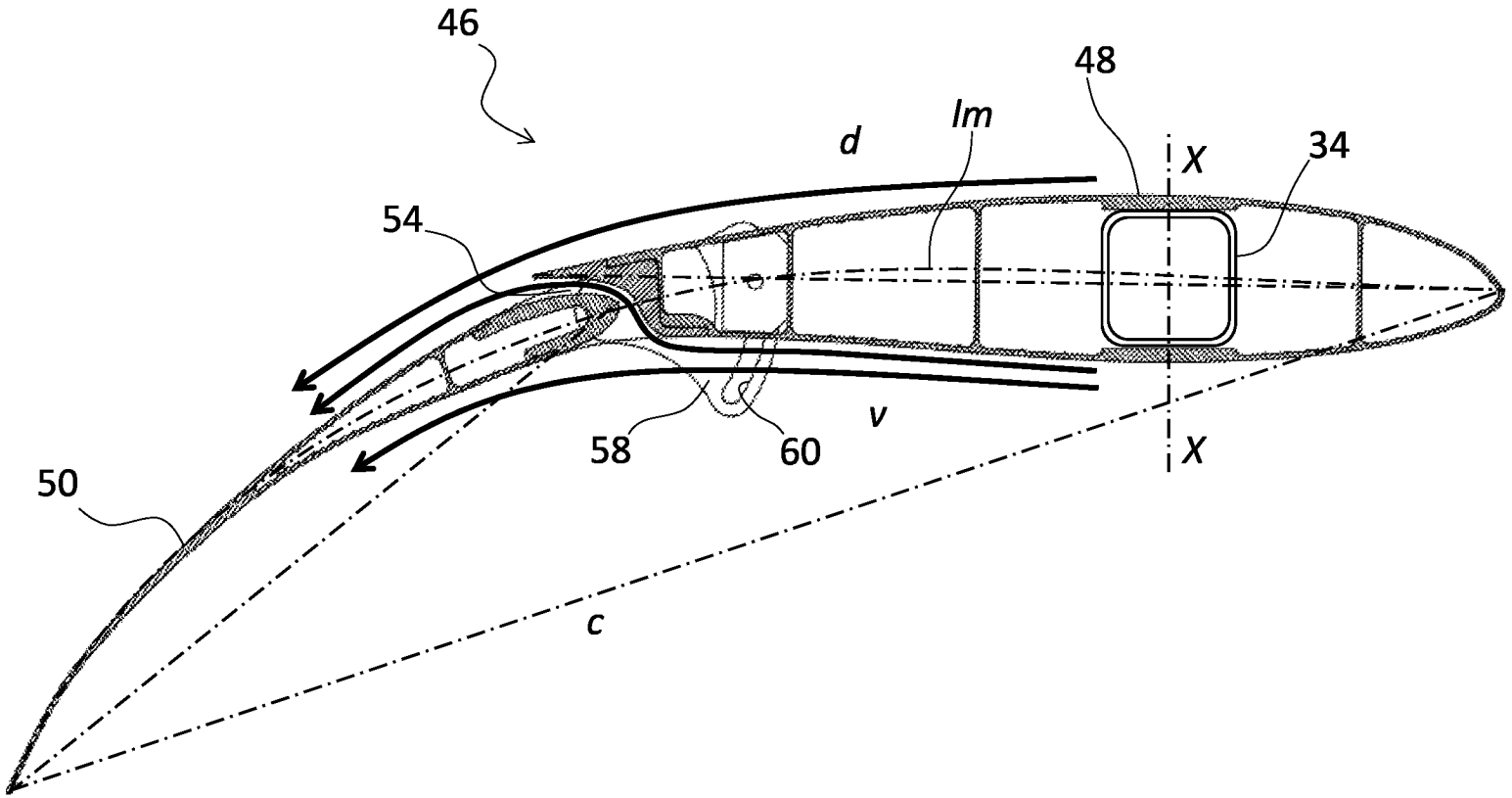
FIG. 10 is a sectional view according to the line X-X of FIG. 9.

In the embodiment shown in FIGS. 10 and 11, the flap 50 is mounted on the blade 38 by means of shaped plates 58 comprising slots 60 shaped like a circle arc and centred at the point of rotation of the flap 50. The slot extension 60 defines the maximum deflection position and the minimum deflection position of the flap 50. During the assembly of the axial fan 32, the flap 50 can be brought to the design deflection position and then secured to the shaped plates 58 to remain firmly in position during the operative life of the axial fan 32.

In accordance with other embodiments (not shown in the figures), the flap 50 is mounted on the blade 38 by means of shaped plates 58 that uniquely define the design deflection position. Then, once the flap is secured to the shaped plates 58, it automatically assumes the design deflection and holds it firmly for the entire operating life of the axial fan 32. That is, in use, the flap 50 is fixed with respect to the blade 38.

Between the semi-airfoil 48 and the flap 50 a channel 54 is defined suitable for allowing a fluid flow from the face v to the back d of the composite airfoil 46. Certain possible embodiments of the channel 54 are depicted in FIGS. 18.*b*, 19 and 20 and will be described in more detail below. Preferably, the channel 54 is defined by smooth walls, suitable for not disturbing the fluid flow they contain. The walls defining the channel 54 are positioned at the aft tip of the semi-airfoil 48 and at the fore tip of the flap 50, respectively. As will be described in greater detail below, the walls are suitable for defining a channel 54 that is smooth and/or converging from the face v to the back d.

As the skilled person can understand, when the composite airfoil 46 is correctly oriented in a fluid flow that hits it (which occurs during normal operation of the axial fan 32) in proximity of the back d of the composite airfoil 46 a depression region is generated, while in proximity of the face v of the composite airfoil 46 an overpressure region is generated. This pressure difference, in a manner known per se, generates the desired aerodynamic forces. Furthermore, in the presence of the channel 54 connecting the face v to the back d of the composite airfoil 46, the pressure difference generates the passage of an amount of fluid that is drawn from the overpressure region to the depressed region. This phenomenon is schematically depicted in FIG. 10, where the thick arrows qualitatively represent the fluid veins of the flow.

In the passage from the face v to the back d of the foil, the fluid flow acquires an amount of energy that accelerates it in the trailing direction from the channel 54. In this way, the flow from the channel 54 accelerates the flow already present on the back d of the composite airfoil 46. This allows the flow adhering to the composite airfoil 46 to be maintained even in conditions where a similar simple airfoil 42 risks reaching stall conditions. In other words, the presence of the channel 54 between the semi-airfoil 48 and the flap 50 allows the composite airfoil 46 to operate at high incidence angles without a risk of stalling. The presence of the channel 54 in the radially inner portion 44 of the blade 38 is advantageous because in this region the flow conditions are particularly critical and the effect of the channel 54 allows to stabilize the flow in the aft region of the back d.

As already mentioned, the semi-airfoil 48 of the blade 38 is intended to be assembled with a predefined pitch angle $\alpha_c$, with respect to the hub 36 of the axial fan 32, by means of the root structure 34. In other words, during the assembly of the axial fan 32, the semi-airfoil 48 and the possible single airfoil 42 of the blade 38 can be oriented according to a pitch angle $\alpha_c$ predefined during design.

In the embodiment of the invention depicted in FIGS. 14 to 17, the blade 38 has constant chord. On the opposite, in the embodiment of the invention depicted in FIGS. 9 to 13, the radially outer portion 40 of the blade 38 is tapered, i.e. the chord shrinks toward the radially outer tip.

Figure 9:
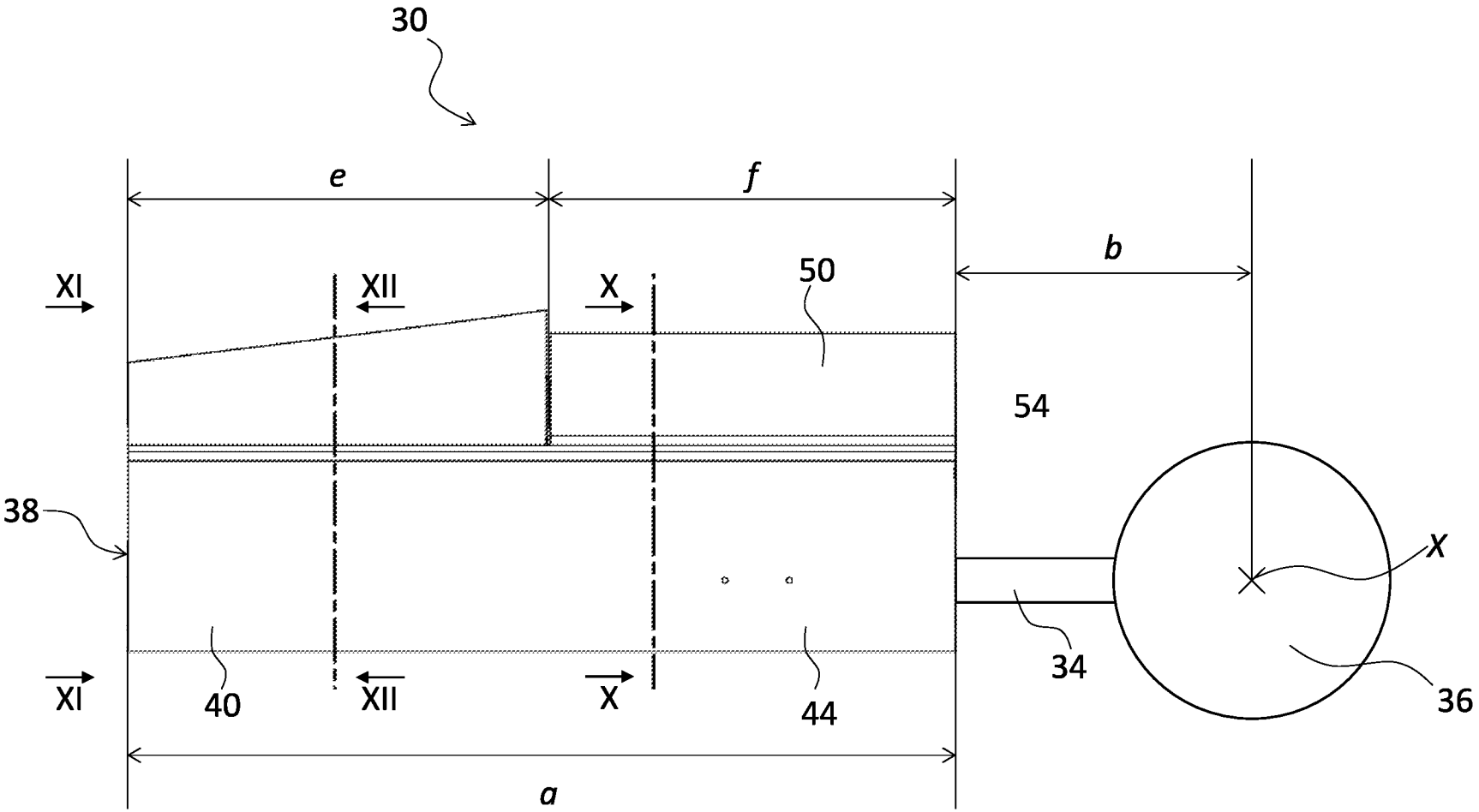
FIG. 9 is a schematic plan view of another blade assembly according to the invention.

In the embodiment of the blade 38 shown in FIG. 9, the radial extension f of the radially inner portion 44 of the blade 38 is approximately equal to the radial extension e of the radially outer portion 40. That is, the radial extension f of the radially inner portion 44 of the blade 38 is about 50% of a.

The axial view of FIG. 11 allows for qualitative evaluation of the difference between the simple airfoil 42 of the radially outer portion 40 and the composite airfoil 46 of the radially inner portion 44 of the blade 38. As can be appreciated, the chord of the composite airfoil 46 is more inclined with respect to the plane $\pi$ than it is the chord of the simple airfoil 42. In other words, the presence of the flap 50 allows to increase the incidence angle of the radially inner portion 44, without any need to introduce a deflection of the blade 38.

This phenomenon is further accentuated in other embodiments that are described below with reference to FIGS. 14 to 17. In such embodiments, one or more radially intermediate portions 62 are included between the radially inner portion 44 and the radially outer portion 40. Each radially intermediate portion 62 has a composite airfoil 46, the composite airfoil 46 comprising a fore semi-airfoil 48 and an aft flap 50, exactly as already described above.

Preferably, the deflection angle of the different flaps 50 of the blade 38 decreases from the inside to the outside.

Preferably, the various portions of the blade 38 have radial extension substantially equal to each other.

Preferably, the different airfoils (single or composite) of the blade 38 have substantially equal chords c.

For the purposes of this discussion, "substantially equal" means that the difference between certain measures is less than 10% of the larger measure.

Specifically for the embodiment of FIGS. 14 to 17, a radially intermediate portion 62 is interposed between the radially inner portion 44 and the radially outer portion 40. As can be appreciated from the comparison of FIGS. 15, 16 and 17, the deflection angle of the flap 50 of the radially intermediate portion 62 is smaller than the deflection angle of the flap 50 of the radially inner portion 44. This feature introduces a sort of piecewise constant twist along the radial extension of the blade 38.

A twist of the blade 38 could have a positive effect with respect to the efficiency of the axial fan 32, due to the different relative speed with respect to the fluid and the different angles of incidence resulting therefrom. However, as the blades 38 of the large diameter axial fans are made, introducing a twist would be impossible without an unacceptable cost increase. The solution of the invention, on the other hand, simply introduces the equivalent of a deflection, albeit in an approximate form.

Figure 14:
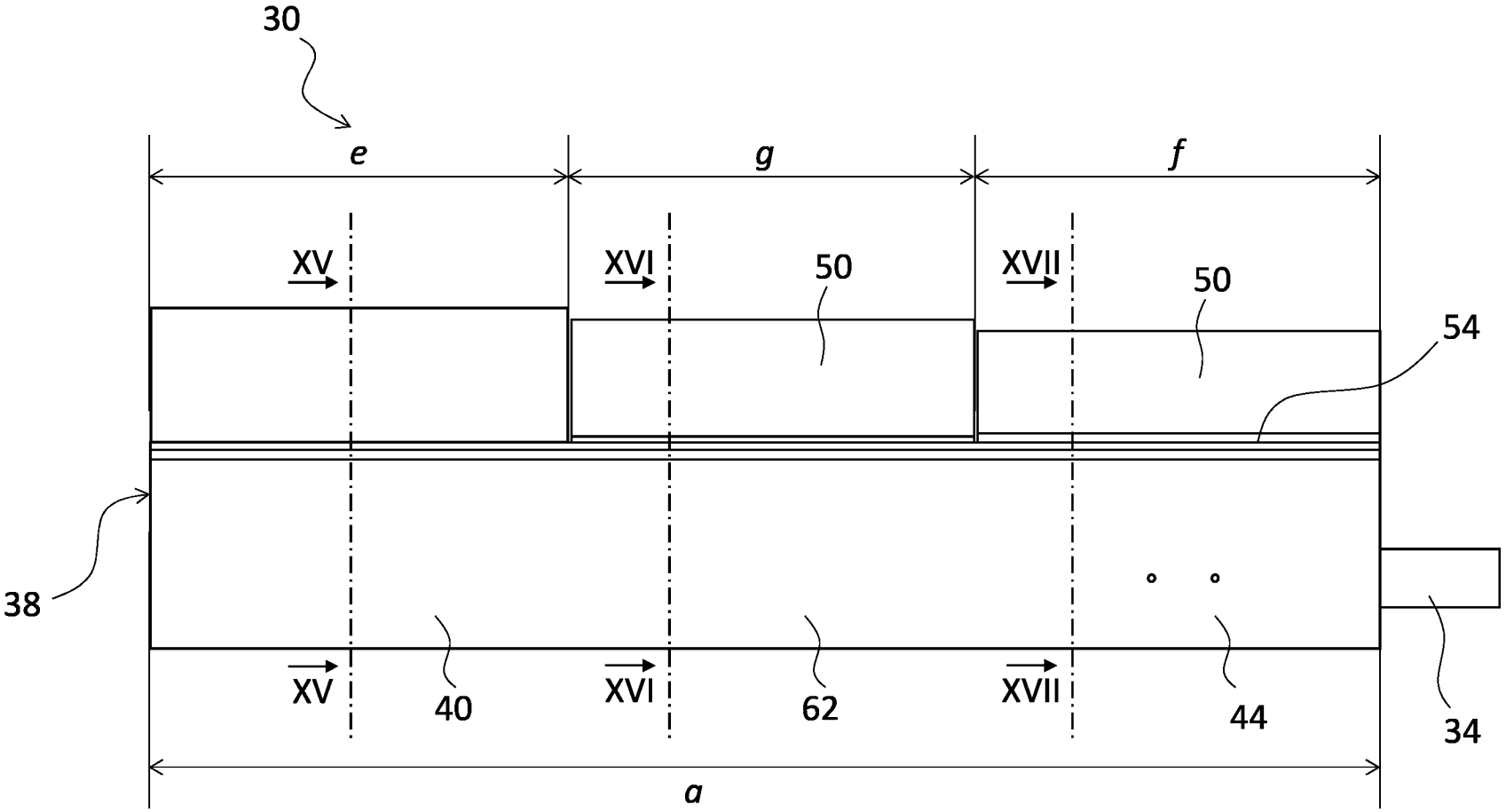
FIG. 14 is a schematic plan view of another blade assembly according to the present invention.
Figure 15:
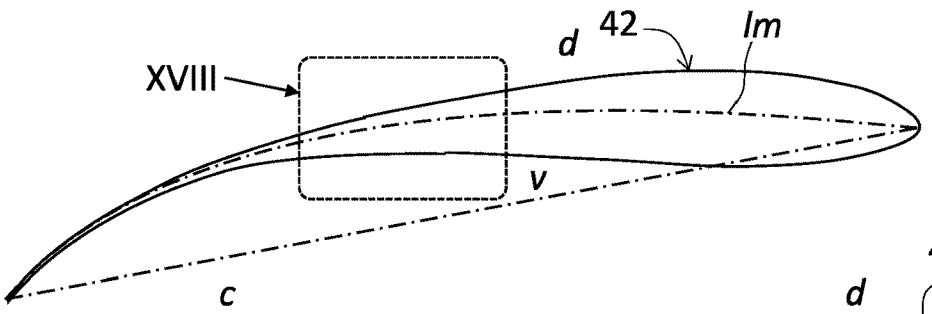
FIG. 15 is a schematic view of the section operated along the line XV-XV of FIG. 14.

Regarding the radially outer portion 40 of the blade 38 of FIG. 14, it must be considered that in FIG. 15 it is represented in section. In such schematic figure, the section takes the form of a simple airfoil 42, shown in more detail in FIG. 18.*a*. FIG. 18.*b* schematically represents another possible solution according to the invention, wherein the radially outer portion 40 of the blade 38 has a composite airfoil 46. In particular, FIG. 18.*b* shows the detail of the leading edge of the flap 50 and the trailing edge of the semi-airfoil 48 and the channel 54 defined by them.

In the embodiment of the blade 38 shown in FIG. 14, the radial extension f of the radially inner portion 44 is substantially equal to the radial extension g of the radially intermediate portion 62 and both are substantially equal to the radial extension e of the radially outer portion 40. In other words, the radial extension f of the radially inner portion 44, the radial extension g of the radially intermediate portion 62 and the radial extension e of the radially outer portion 40 are respectively about 33% of a.

In some embodiments of the invention, the blade 38 further comprises walls 74, positioned at the border between two adjacent radial portions, suitable for at least partially closing, in the radial direction, the opening that is generated between two adjacent flap portions 50 oriented with different deflection angles. For example, in each of the embodiments of the invention depicted in FIGS. 21 to 24, the blade 38 comprises a wall 74, located at the border between the radially outer portion 40 and the radially inner portion 44. In other embodiments, the blade 38 may comprise more than one wall 74. For example, in an embodiment similar to that of FIG. 14, the blade 38 may comprise a wall 74 at the border between the radially outer portion 40 and the radially intermediate portion 62 and another wall 74 at the border between the radially intermediate portion 62 and the radially inner portion 44.

The walls 74 may have different shapes and different extensions in tangential direction. For example, in some embodiments, the wall 74 tangentially engages the entire blade 38, while in other embodiments the wall 74 tangentially engages the flap 50 alone. In some instances, as in the example of FIG. 22, the wall 74 may extend such that it exceeds the chord c in a tangential direction, extending forward of the leading edge and backward of the trailing edge of the blade 38. In other instances, as in the example of FIG. 21, the wall 74 may extend from the leading edge of the flap 50 rearward, to extend rearward of the trailing edge of the blade 38. In still other cases, as in the example of FIG. 23, the wall 74 may consist of a combination of the walls 74 described above in relation to FIGS. 21 and 22. Finally, in still other cases, as in the example of FIG. 24, the wall 74 takes the form of a mixtilinear triangle that completely closes, in the radial direction, the opening that is generated between two adjacent flap portions 50 oriented with different deflection angles.

The walls 74 may flank, replace, or integrate the shaped plates 58.

The walls 74 allow limiting the turbulence due to air recirculation made possible by interruptions of the flap 50 along the radial extension of the blade 38. In addition, the walls 74 extending forward of the leading edge also perform a similar function to the anti-slip panels (or wing fences) sometimes employed on the arrow wings of aircraft.

Figure 13:
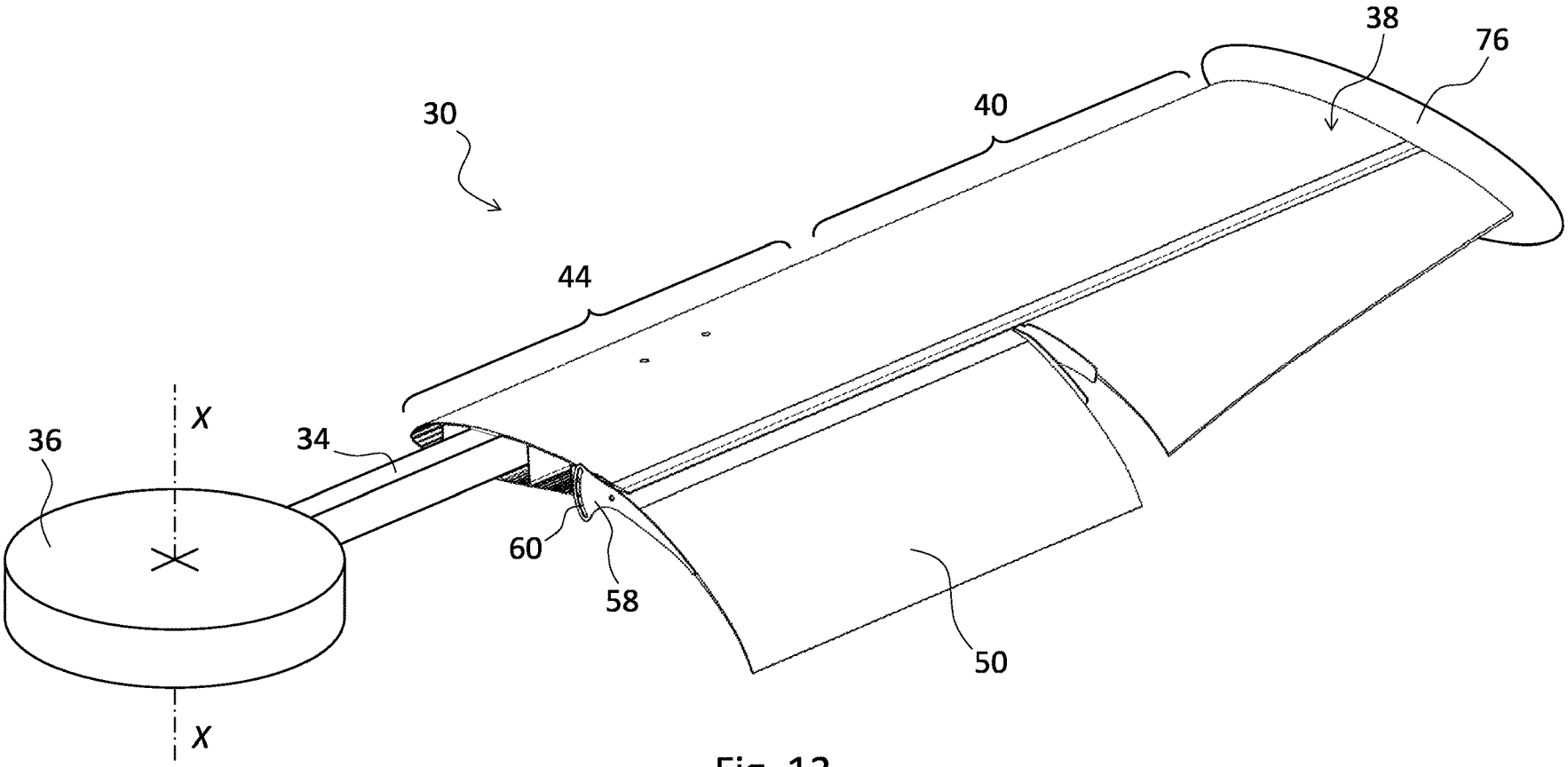
FIG. 13 is an axonometric view of the blade of FIG. 9.

In some embodiments of the invention, such as that of FIG. 13, the blade 38 further comprises a winglet 76 (or wingtip device), positioned at the radial tip. The winglet 76, known per se, allows to limit the turbulence due to air recirculation at the radial tip of the blade 38.

Below is described a possible method for making a blade 38 according to the invention.

As mentioned above, the blades 38 for large diameter axial fans 32 are usually obtained from extruded (aluminum) or pultruded (fibre-reinforced composite) semi-finished products. The section of the semi-finished products, constant along their entire extension, is shaped so as to reproduce a predetermined airfoil. For blades 38 having reduced chord c the airfoil can be monolithic, i.e. made of one piece. By way of example, with regard to extruded aluminium airfoils, they may be monolithic, i.e. made of a single piece, for chords approximately within 500 mm. Still by way of example, with regard to pultruded fiberglass airfoils, they may be monolithic, i.e. made of a single piece, for chords approximately within 1000 mm. On the contrary, for blades 38 having chord c greater than as indicated, it is preferable to create the airfoil by juxtaposing two or more components 64. For example, a first component $\mathbf{64}_1$ may constitute the fore part of the foil and a second component $\mathbf{64}_2$ may constitute the aft part of the foil. Typically, the monolithic foil and/or the various components 64 that constitute it comprise external walls shaped so as to create the desired airfoil and internal walls that have a structural stiffening function and that define closed cells within the foil. This structure allows the blade 38 to be given considerable mechanical strength, in particular with respect to the bending and twisting stresses to which it is subjected.

In both cases, whether the foil is monolithic or composed of different components 64, the blade 38 according to the invention can be made in a simple and economical manner, introducing only a few processes and few additional elements with respect to the prior art.

In the case in that the foil is monolithic, the extruded or pultruded semi-finished product may be cut longitudinally at least for the extension of the blade portion 38 to be made with a composite foil 46. In this manner, this case becomes similar to the case wherein the foil is obtained from two separate components $\mathbf{64}_1$ and $\mathbf{64}_2$. To obtain a composite airfoil 46 according to the invention, it is possible to complete the two components $\mathbf{64}_1$ and $\mathbf{64}_2$ of the original airfoil by means of suitable accessory shaped bars 66. A first accessory shaped bar $\mathbf{66}_1$, to be coupled to the aft component $\mathbf{64}_1$, is shaped to create a suitable leading edge for the flap 50. A second accessory shaped bar $\mathbf{66}_2$, to be coupled to the fore component $\mathbf{64}_2$, is shaped to complete the semi-airfoil 48 as described above. In particular, the main purpose of the second accessory shaped bar $\mathbf{66}_2$ is to define a smooth and regular channel 54 for the passage of the flow from the face v to the back d of the composite airfoil 46.

Therefore, in accordance with what described above, the at least one portion intended to assume the desired composite airfoil 46 is provided. On the other hand, starting from the semi-finished product having the simple airfoil 42, the remaining radially outer portion 40, having extension e, is obtained. The radially outer portion 40 having a simple airfoil 42 is structurally attached to the component $\mathbf{64}_2$ of the radially inner portion 44 having the semi-airfoil 48. Preferably at the radial tips of the radially inner portion 44 are added the shaped plates 58 described above for mounting the flap 50. Then, the flap 50 may be constrained to the shaped plates 58 according to the deflection angle $\alpha_f$ defined during the design step.

Adding the root structure 34 to the axially inner end of the blade 38 results in the blade assembly 30, intended to be assembled on the hub 36.

Here, it should be noted that the accessory shaped bars 66 described above and necessary to modify the airfoil components do not have any structural function, but only have to perform a shape function for aerodynamic purposes. Such accessory shaped bars 66 are therefore not critical pieces and can be made at low cost, for example by simple extrusion of polymer material. The simplicity of production of these accessory shaped bars 66 allows to produce various types thereof, possibly also developing them ad hoc for a single application. In this regard, it is also to be considered what is reported below with reference to FIGS. 18 to 20. Moreover, still due to their ease of construction, the accessory shaped bars 66 do not imply a significant increase in the production cost of the axial fan 32 as a whole.

FIGS. 18 to 20 show, although schematically, the detail of the region in which an airfoil of known type is modified according to the invention. FIG. 18.*a* shows a detail of the simple airfoil 42, as could be employed in the radially outer portion 40 of the blade 38. In this specific case, the foil is made of three different components: an aft component $\mathbf{64}_1$, a median component $\mathbf{64}_3$ and a fore component $\mathbf{64}_2$.

FIG. 18.*b* shows an alternative embodiment, wherein the simple airfoil 42 is replaced by a composite airfoil 46 with the same geometric characteristics. In such a case, the airfoil is modified by replacing the median component $\mathbf{64}_3$ with two accessory shaped bars $\mathbf{66}_1$ and $\mathbf{66}_2$. Subsequently, the flap 50 is assembled at a deflection angle such that the composite airfoil 46 substantially coincides with the simple airfoil 42 of FIG. 18.*a*.

Figure 16:
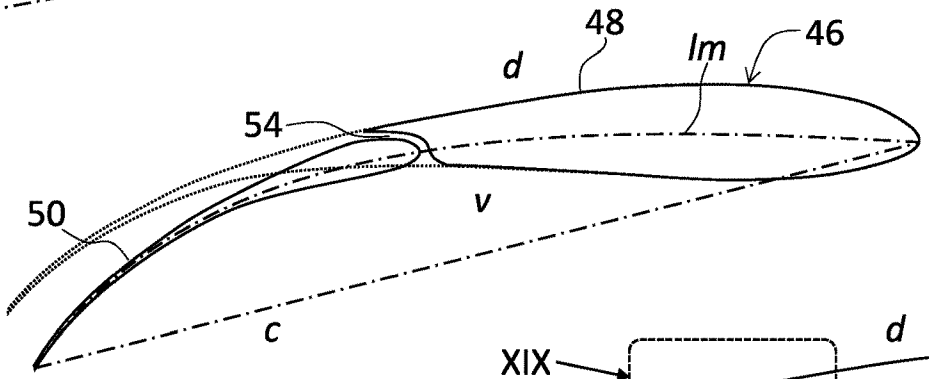
FIG. 16 is a schematic view of the section operated along the line XVI-XVI of FIG. 14.

According to an embodiment of the invention, the airfoil is modified to create a composite airfoil 46 suitable for use in the radially inner portion 44 of the blade 38. In this specific case, the median component $\mathbf{64}_3$ is removed and replaced by two accessory shaped bars $\mathbf{66}_1$ and $\mathbf{66}_2$. As can be seen in FIGS. 16, 17 and 18, the first accessory shaped bar $\mathbf{66}_1$, coupled to the aft component $\mathbf{64}_1$, is shaped so as to create a suitable leading edge for the flap 50. Still with reference to FIGS. 18.*b*, 19 and 20, it can be noted that the second accessory shaped bar $\mathbf{66}_2$, to be coupled to the fore component $\mathbf{64}_2$, can be shaped differently to complete the semi-airfoil 48 of the invention. In particular, in FIG. 18.*b* the second accessory shaped bar $\mathbf{66}_2$ has a shape that is limited to simulate the back of a similar simple airfoil 42 and defining a smooth channel 54 between the semi-airfoil 48 and the flap 50. In the detail of FIG. 19, the second accessory shaped bar $\mathbf{66}_2$ is capable of defining a smooth and convergent channel 54 between the semi-airfoil 48 and the flap 50. It is in fact known that a converging channel 54 allows to make the best use of the energy acquired by the flow during the passage through the channel 54. In the detail of FIG. 20 it can eventually be noted that the second accessory shaped bar $\mathbf{66}_2$ is further different and is capable of defining a channel 54 smooth and convergent for a deflection angle $\alpha_f$ of the flap 50 greater than that of the preceding FIGS. 18.*b* and 19. In other words, due to the low cost of the accessory shaped bars 66, different types can be arranged, for example intended for use with different deflection angles $\alpha_f$ of the flap 50, or even create an accessory shaped bar 66 specific to the single application. It is worth remembering that the deflection angle $\alpha_f$ of the flap 50 is defined during the design phase. During assembly of the axial fan 32, the single flap 50 is secured to the blade 38 for then maintain the same position throughout the operating life, unless a revision of the design is required. For this reason, the choice of the most suitable accessory shaped bar 66 can be made directly at the design stage, by virtue of the deflection angle $\alpha_f$ defined for the flap 50 in the specific application. According to another aspect, the invention relates to a rotor 56 comprising a hub 36 and a plurality of blades 38 as described above. The number of blades 38 of the rotor 56 is defined during the design phase. Studies conducted by the applicant have shown that, due to the particular shape of the blade 38 according to the invention, it is often possible to reduce the number of blades 38 in a rotor 56 according to the invention compared to the number of traditional blades 38 that would be required in a rotor 56 of a known type. This of course allows significant savings in the purchase costs of the axial fan 32 and also allows for more regular operation of the axial fan 32. As is known to the skilled person, as the number of blades 38 increases, the aerodynamic interaction between each blade 38 and that following it in the rotation motion also increases. This interaction tends to deteriorate the behaviour of the axial fan 32 as a whole.

According to another aspect, the invention relates to an axial fan 32 comprising a rotor 56 as described above and a motor 68 suitable for rotating the rotor 56 about the rotation axis X. The motor 68, in a manner known per se, must be capable of providing the power necessary to keep the rotor 56 in rotation at the design steady state for an indefinite time.

According to another embodiment of the invention, the axial fan 32 further comprises a duct 70. Thus, in a manner known per se, the axial fan 32 is preferably a ducted axial fan 32. The duct 70 is intended to limit the aerodynamics effects that disturb the airflow near the end of each blade 38. The presence of the duct 70, helping to maintain the air flow in the axial direction, increases the overall efficiency of the axial fan 32.

Preferably, the axial fan 32 also comprises a framework 72 suitable for holding the axial fan 32 firmly when the rotor 56 rotates about the rotation axis X. The framework 72 must be suitable for holding the axial fan 32 firmly in all operation conditions, both during the transient start and stop speeds and during the design steady state regime. In this type of application, as is known to the skilled person, the main problem from a structural point of view is that of the vibrations and cyclic stresses that derive from it. Therefore, the framework 72 must be made by carefully considering the frequencies themselves to avoid resonance phenomena that can have catastrophic results.

As the skilled person can easily understand, the invention allows to overcome the drawbacks highlighted previously with reference to the prior art.

Figure 7:
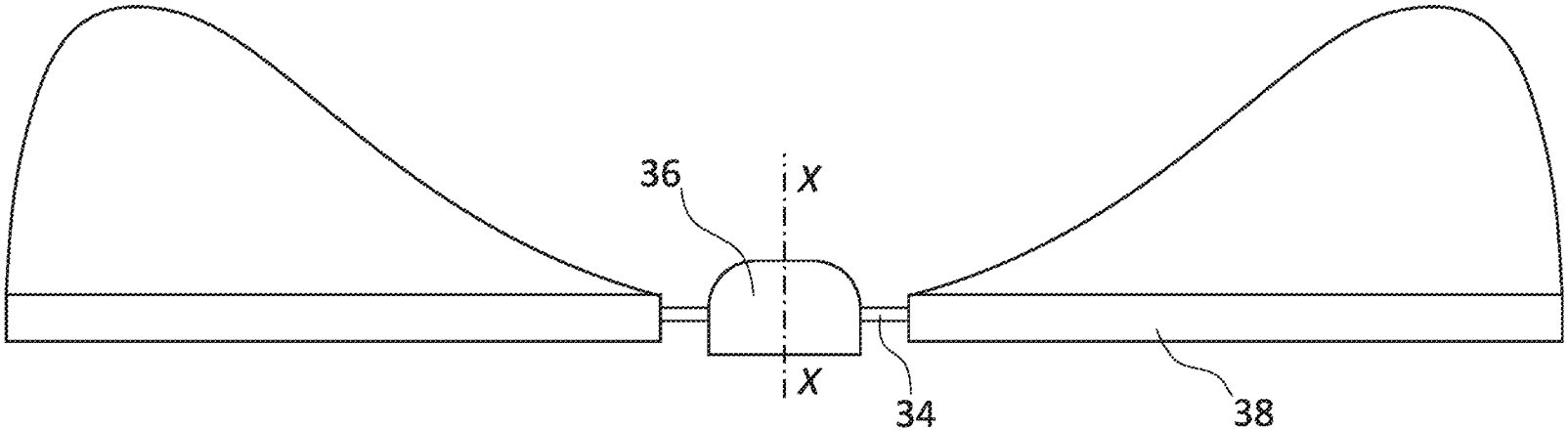
Fig. 7 (prior art)
FIG. 7 is a diagram showing qualitatively, for an axial fan according to the prior art, the flow distribution as a function of the distance from the rotation axis.
Figure 8:
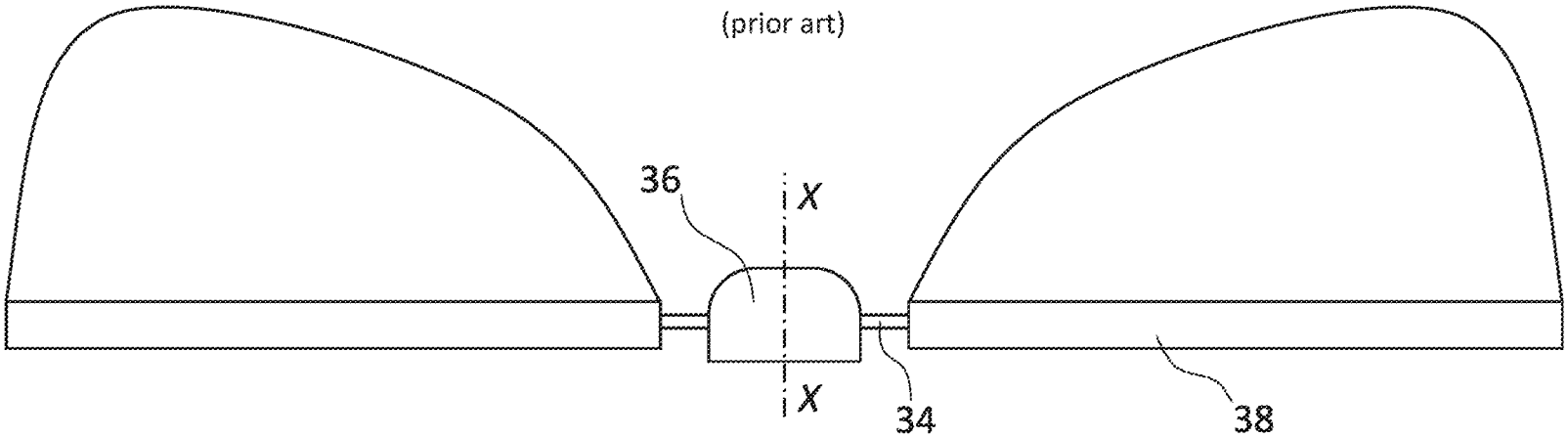
FIG. 8 is a diagram showing qualitatively, for an axial fan according to the invention, the flow distribution as a function of the distance from the rotation axis.

In particular, the present invention provides a blade 38 for an axial fan 32 which allows to improve the overall efficiency of the axial fan 32. In particular, comparing the curves of FIGS. 7 and 8 with each other, it is possible to appreciate qualitatively, that the blade 38 and the axial fan 32 according to the invention allow to exploit more efficiently even the radially innermost sections.

Figure 5:
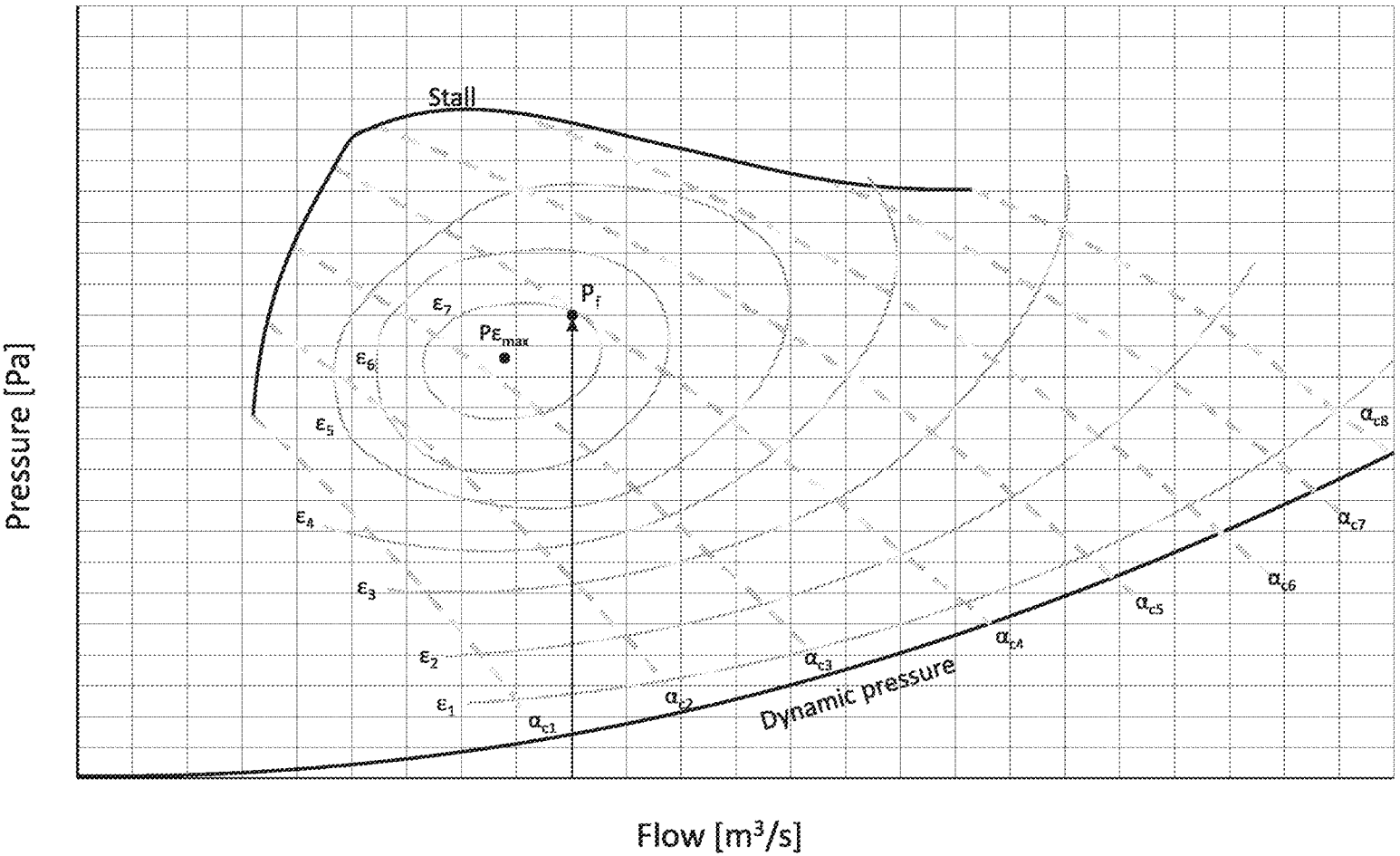
Fig. 5 (prior art)
FIG. 5 is a diagram showing qualitatively the characteristic curve, the point of maximum efficiency and the point of operation of an axial fan according to the prior art.
Figure 6:
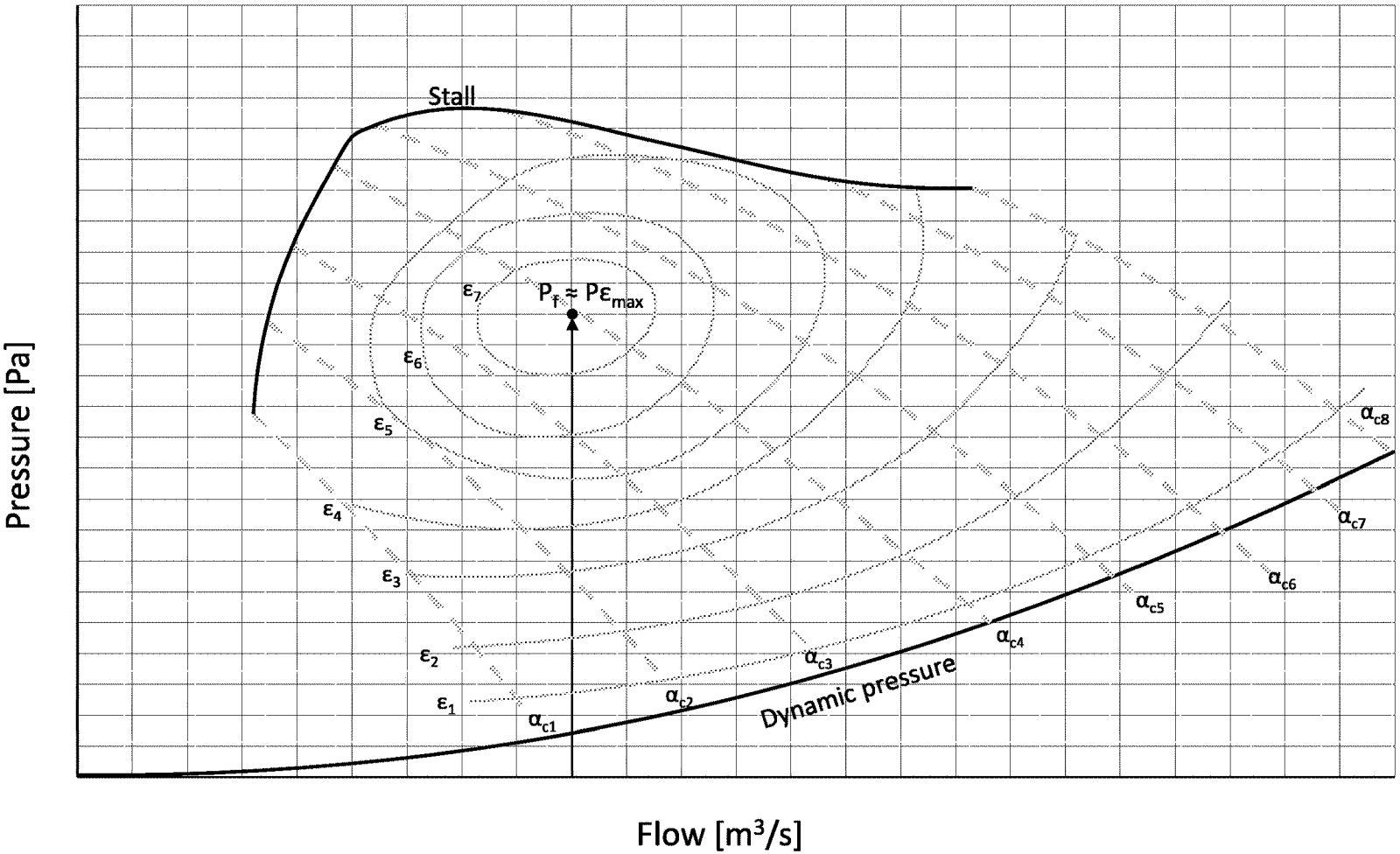
FIG. 6 is a diagram showing qualitatively the characteristic curve, the maximum efficiency point and the operating point of an axial fan according to the invention.

Furthermore, the present invention provides a blade 38 for an axial fan 32 which allows to vary the configuration in order to vary the characteristic curve of the axial fan 32. It is to be considered in this regard the diagram of FIG. 6, made similar to the diagram of FIG. 5. As the skilled person can appreciate, although the diagram represents the curves in a qualitative manner, the technical characteristics of the invention allow the efficiency curves $\varepsilon_n$ to be translated at will on the Flow-Pressure plane, so as to bring the maximum efficiency point $P\varepsilon_{max}$ to be substantially coincident with the operating point $P_f$. In other words, in almost the entire operating life of the fan 32 according to the invention, the potential of the latter is fully exploited. This results in a sharp reduction in the energy used to operate the fan.

It is clear that the specific features are described in relation to various embodiments of the invention, with exemplifying and non-limiting intent. Obviously, a person skilled in the art may make further modifications and variations to the present invention, in order to satisfy contingent and specific needs. For example, the technical features described in connection with an embodiment of the invention may be inferred from it and applied to other embodiments of the invention. However, such modifications and variations are contained within the scope of protection of the invention, as defined by the following claims.

The invention claimed is:

1. A blade assembly for a large dimension axial fan having a rotation axis, comprising:

a root structure intended to mechanically connect the blade assembly to a hub of the axial fan;

a blade comprising at least one radially inner portion and a radially outer portion, the radially outer portion of the blade having a simple airfoil and the radially inner portion of the blade having a composite airfoil comprising a fore semi-airfoil and an aft flap, wherein:

the semi-airfoil of the blade is assemblable with a predefined pitch angle with respect to the hub of the axial fan by means of the root structure;

the aft flap is mounted on the blade such that it can be fixed in a position comprised between a maximum deflection position and a minimum deflection position with respect to the pitch angle; and between the fore semi-airfoil and the aft flap a channel is defined suitable for allowing a fluid flow from a face to a back of the composite airfoil.

2. The blade assembly according to claim 1, wherein the blade has a radial extension and wherein the radial extension of the at least one radially inner portion is comprised between 20% and 70% of the radial extension of the blade.

3. The blade assembly according to claim 1, wherein between the radially inner portion and the radially outer portion one or more radially intermediate portions are comprised, wherein each radially intermediate portion has a composite airfoil.

4. The blade assembly according to claim 3, wherein the radially outer portion, the radially inner portion, and the radially intermediate portion of the blade each have substantially equal radial extensions.

5. The blade assembly according to claim 3, wherein the composite airfoil of the radially inner portion, the composite airfoil of the radially intermediate portion, and an airfoil of the radially outer portion of the blade have chords substantially equal among them at least in one respective section.

6. The blade assembly according to claim 1, wherein, in use, the aft flap is fixed with respect to the blade.

7. The blade assembly according to claim 1, wherein the channel is smooth and/or convergent from the face towards the back of the composite airfoil.

8. The blade assembly according to claim 1, wherein the blade further comprises walls, placed at the border between two adjacent radial portions, the walls being suitable for at least partially closing, in the radial direction, the opening that is generated between two adjacent flap portions oriented with different deflection angles.

9. The blade assembly according to claim 1, wherein the blade further comprises a winglet at the radial tip.

10. A rotor for a large dimension axial fan, comprising a hub and the blade assembly according to claim 1.

11. A large dimension axial fan, comprising the rotor according to claim 10 and a motor suitable for rotating the rotor about the rotation axis.

12. The large dimension axial fan according to claim 11, further comprising a duct.

13. The large dimension axial fan according to claim 11, further comprising a framework suitable for firmly holding the axial fan in all its operation conditions.

14. The blade assembly according to claim 2, wherein the radial extension of the at least one radially inner portion is comprised between 40% and 60% of the radial extension of the blade.

* * * * *